US005334238A

United States Patent [19]

Goodson et al.

[11] Patent Number: 5,334,238

[45] Date of Patent: Aug. 2, 1994

[54] CLEANER METHOD FOR ELECTROSTATIC PRECIPITATOR

[75] Inventors: Forrest R. Goodson, San Jose; Thomas P. Rudy, Saratoga, both of Calif.

[73] Assignee: United Technologies Corporation, Hartford, Conn.

[21] Appl. No.: 618,773

[22] Filed: Nov. 27, 1990

[51] Int. Cl.[5] ..... B03C 3/80

[52] U.S. Cl. ..... 95/59; 95/74; 96/43; 96/50

[58] Field of Search ..... 55/12, 117, 120, 121, 55/13, 114, 112; 15/312.2, 405, 406; 95/59, 74; 96/28, 43, 48, 50, 52

[56] References Cited

U.S. PATENT DOCUMENTS

| | | | |
|---|---|---|---|
| 2,249,801 | 7/1941 | White | 55/12 |
| 2,851,347 | 9/1958 | Schlecht et al. | 75/362 |
| 2,900,245 | 8/1959 | Beller | 75/362 |
| 2,974,342 | 3/1961 | Fell | 15/312.2 |
| 4,073,874 | 2/1978 | Fukushima | 423/500 |
| 4,357,151 | 11/1982 | Helfritch et al. | 55/12 X |
| 4,505,723 | 3/1985 | Zahedi et al. | 55/117 |
| 4,565,660 | 1/1986 | Hultholm et al. | 261/121.1 |
| 4,826,671 | 5/1989 | Arndt et al. | 423/633 |
| 4,854,981 | 8/1989 | Goodson et al. | 149/2 |
| 4,881,994 | 11/1989 | Rudy et al. | 149/109.4 |

*Primary Examiner*—Richard L. Chiesa
*Attorney, Agent, or Firm*—Alan C. Cohen

[57] ABSTRACT

Disclosed is a novel method for cleaning an electrostatic precipitator by directing a stream of cleaning gas through a flexible tube positioned inside the electrostatic precipitator. The stream of gas causing the flexible tube to move randomly directing the stream of gas at the precipitator plates with sufficient force to dislodge particles adhered to such plates.

1 Claim, 1 Drawing Sheet

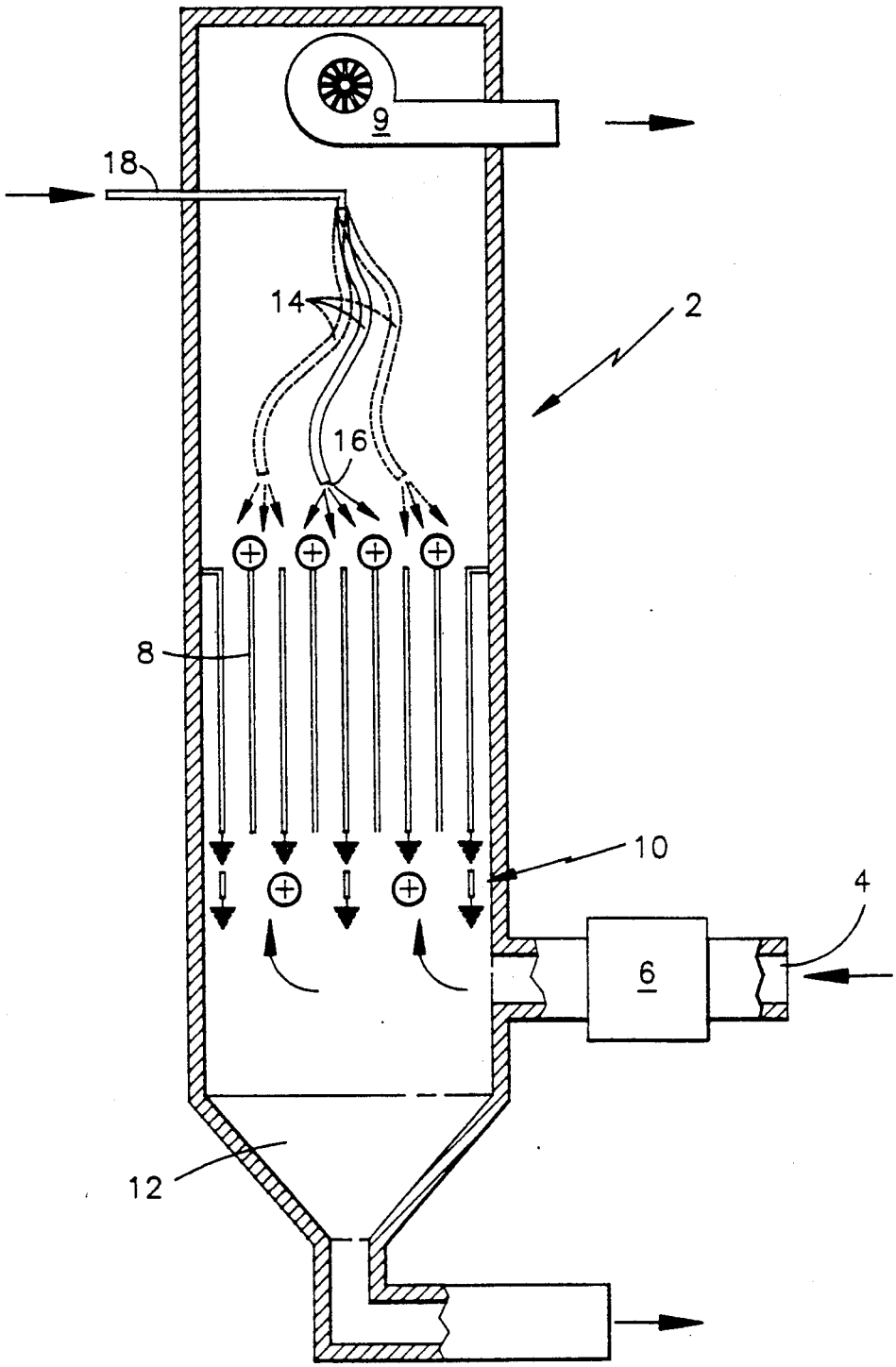
9
18
14
2
16
8
10
4
6
12

CLEANER METHOD FOR ELECTROSTATIC PRECIPITATOR

TECHNICAL FIELD

The technical field to which this invention relates is cleaning processes for particle precipitators, specifically electrostatic precipitators for fine particles.

BACKGROUND OF THE INVENTION

The manufacture of very fine particles, particularly extremely fine particles such as iron oxide, utilizes an electrostatic precipitator to remove the fine particles from the production stream. In the case of iron oxide particles, this means precipitating the particles, which are below about 100 Å in size, from a moving stream of oxidizing gas. Generally, this is performed by passing the oxidizing gas and the particles through an ionizer (first stage) in which a direct current corona discharge electrically charges the particles. These charged particles then enter the collector (second stage) of the precipitator. The collector consists of a series of electrically charged, parallel, conductive plates which are polarized such that in general each plate of a given, constant polarity (positive or negative) is situated between two plates of opposite polarity. Each entering charged particle thus is attracted to, and adheres to, a collector plate of opposite polarity. The collected product is harvested periodically by physical removal from the collector assembly.

The problem with this process and particularly with the collection of fine iron oxide particles is that all commercially available, two-stage, electrostatic precipitators are designed for cleaning gas (usually air) streams containing only very low concentrations of particulate solids. After a long period of operation they are conventionally shut down, and the small amount of precipitated solids is removed, commonly by washing, an expensive process that would cause irreversible agglomeration and degradation of fine iron oxide particles. In a few applications in which very dense particles (such as those from arc-welding operations) are collected, in situ "rapping" (i.e., hammering or vibration) of the collector suffices for cleaning. Unfortunately the fine iron oxide particles manufactured by the process of interest are present in very high concentration in the gas stream, and they rapidly deposit on collector plates as thick, fluffy layers of high electrical resistivity and exceedingly low density. The thickness and high resistivity promote arcing between collector plates, a process that dislodges massive clots of the product back into the gas stream. These clots escape from the precipitator and thus are lost to the exhaust gases. For efficient recovery of the collected fine iron oxide particles it is necessary to shut down the precipitator frequently and thoroughly remove the precipitate. Rapping depends on inertial forces on the adherent precipitate. Because such forces are minimal in the case of the fine iron oxide particles, cleaning by rapping or vibration is very inefficient. Another disadvantage of rapping is the injuriously high noise level to which plant operators may be exposed.

Therefore, what is needed in this art is a cleaning method which is quiet, efficient, less time consuming and cost effective.

DISCLOSURE OF THE INVENTION

The present invention discloses a method for cleaning an electrostatic precipitator useful in the production of very small particles comprising introducing a flexible tubular structure into the precipitator housing and injecting a flow of cleaning gas into the precipitator housing through the flexible tubular structure at such a velocity that the reactive force of the expelled gas causes the tip of the flexible tube to move about randomly directing the expelled gas across the surface of the precipitation plates causing any adhered particles to be dislodged from the plates.

BRIEF DESCRIPTION OF THE DRAWINGS

The sole drawing figure depicts a schematic of the present invention.

BEST MODE FOR CARRYING OUT THE INVENTION

The process in which this invention will find its most immediate use is in the production of iron oxide powder. Such a process is set forth in commonly assigned U.S. Pat. 4,854,981 (the contents of which are incorporated herein) and other similar methods. However, it is believed that this process may be used to clean electrostatic precipitators of adhered particles other than iron oxide.

Generically, the iron oxide is produced by introducing a flow of vaporized iron-containing compound into a reaction chamber, wherein the gas is contacted with a heated oxidizing gas causing the iron-containing compound to be oxidized to solid particles of iron oxide. The following discussion refers to the sole drawing figure which is a drawing of the present invention and is meant to be exemplary and not limiting. The gas borne particles issuing from the reactor (not shown) are introduced into an electrostatic precipitator 2 through an intake tube 4 having a shutoff valve 6.

The particles are then drawn up through the electrostatic precipitator 2 by an exhaust blower 9 (such precipitators are well known in the art and a complete description of the component parts and operation would be known to those skilled in this art). As the particles are drawn up into the precipitator 2, they first pass through the ionizer 10 in which they become electrically charged by collision with ionized gas produced by corona discharge. The charged particles now progress between the alternately polarized plates 8 of the collector 2. In the strong electrical field the charged particles migrate to, and adhere to, collector plates of opposite polarity. When the light, fluffy deposits of precipitated fine iron oxide particles build up to such a thickness that interplate arcing begins to dislodge them into the gas stream, the feed of iron pentacarbonyl to the reactor is stopped, intake shut-off valve 6 is closed, the exhaust blower 9 is stopped, and the bag filter blower (not shown) is started. Thus, the flow of air in the precipitator is reversed, entering through the exhaust outlet and exiting through the product hopper 12 to the bag filter.

As shown, a flexible tube 14 has been introduced into the precipitator housing 2. The flexible tube 14 may be formed of any material which is compatible with the operating environment within the precipitator. This is particularly important where, as in this preferred illustration, the flexible tube is a permanent fixture remaining within the precipitator during production of iron oxide. The choice of material will depend on the particular design of the precipitator, temperature, composition of the gas stream, nature of the deposits to be removed, and the velocity of the cleaning gas required to dislodge the precipitate. All of this may be determined empirically and without undue experimentation.

The flexible tube will generally be formed of an elastomeric material, plastic or possibly metal. The limitation being that the modulus should not be so high that it requires extremely high flow rates to cause the tube to move in the desired random motion. The preferred material for long-term durability is an oxidation and ozone-resistant rubber, such as Norprene or EPDM (ethylene/propylene/diene monomer). The environment within the precipitator is ordinarily benign except for elevated concentration of ozone formed in the ionizer. Also, it is desirable that any portion of the tube that may collide with the walls or other internal structural members of the precipitator be soft, resilient, and resistant to abrasion. Any material abraded from the tube or precipitator structure will be collected with, and contaminate, the product. The diameter of the opening 16 within the tube 14 is also a variable and should not be so small that the velocity of the jet of cleaning gas be reduced by turbulence below about 50 feet/second at the bottom of the collector plates and should not be so large that consumption of compressed cleaning gas becomes extravagant. Typically, an orifice or opening in the tube tip should be between about 3/16 inch and about one inch with about ¼ inch to about ⅜ inch preferred. It is preferred that the exit end of the flexible tube be weighted to maintain the tip's downward projection. Moreover, it is preferred that the exit end be cushioned to prevent damage during the frequent impacts on the enclosure walls. Both of the latter objectives are conveniently achieved by constructing a two-part flexible tube assembly by merely attaching a short length of thicker (hence heavier) flexible tubing to the exit of the thinner, upper flexible tubing. The attachment may be made by a variety of conventional means. A particularly convenient means is the use of an internal, double-ended, barbed hose coupler.

The third important variable is the flow or speed with which the cleaning gas is exited through the tip of the tube. Generally, the flow rate in the tube at its exit will be sonic (i.e., above 1100 feet per second in the case of air) in order to provide an effectively high velocity of the turbulent gas stream issuing from the bottom of the collector assembly. A velocity of about 50 feet per second to about 150 feet per second will be required at the latter location to ensure adequate removal of the particles deposited on the precipitator plates. Therefore, the design of the tubular structure and its position in the precipitator should be such that it can provide such flow rates. The preferred minimum flow rate will be about 50 feet per second to about 100 feet per second.

The cleaning gas may be practically any gas. The only limitation being that it should not have any adverse reaction with or on the particles in the precipitator. Preferably such a gas should be plentiful and inexpensive. Gases which fits this criteria are air, nitrogen, etc.

Additionally, the tip 16 of the flexible tube should be positioned in close enough proximity to the component parts to be cleaned so that the flow of gas will not be too dissipated over too great a distance and therefore not be sufficient to dislodge the particles. Typically, at rest the exit of the flexible tube should be about 10 mm to about 25 mm above the precipitator plates.

Naturally, there is no reason to limit this cleaning process to the use of a single flexible tube. A plurality of flexible tubes operating sequentially could also be used if desired.

During the operation of the cleaner, the electrostatic precipitator is turned off and a controlled flow of gas is forced through the tube. Conventional metering devices may be used to control the flow and the gas may be pressurized or compressed to generate the necessary flow rate. This gas enters the tube through opening 18 and passes through the passageway in the tube 14 where it exits through the orifice 16. As the gas exits the tube, it causes a natural reaction propelling the unrestrained tube in a desired random direction such that the exiting gas is directed primarily at the precipitator plates 8 and thereby causing the fine particles adhered to the plates to be removed and carried away.

EXAMPLE

The cleaning method of the present invention was applied to the production of iron oxide using an Aercology electrostatic precipitator Model EPP1200X2.

Iron pentacarbonyl was vaporized at a rate of about 6 grams per minute and oxidized in a stream of air that had been heated to approximately 625° F. The product stream of superfine iron oxide and air was cooled by passage through a coiled aluminum duct and then further cooled by dilution with air at room temperature. The cooled, diluted product stream entered the precipitator where the iron oxide particles were removed from the product stream and deposited on the collector plates in the conventional manner. After 55 minutes of operation, the electrostatic precipitator was shut down and the cleaning operation was begun.

The precipitator housing had been fitted with a 14 inch length of 0.25 inch internal diameter x 0.375 inch outside diameter seamless rubber tubing (available from McMaster-Carr Supply Co., Los Angeles, Calif., Catalog No. K5232K15) connected by means of a double ended 0.25 inch barbed hose adaptor to a six inch length of heavy wall rubber tubing having an internal diameter of 0.25 inch and an outside diameter of 1.25 inch at the outlet tip (available from McMaster-Carr Supply Co., Los Angeles, Calif., Catalog No. K8637K15). The inlet end of the tube assembly was connected to and supported by a rigid gas inlet tube such that when the flexible tube was at rest (no gas passing through said tube) its exit orifice was positioned just above the center of the vertical collector plate assembly. The rigid inlet tube was connected to a source of 100 psi nitrogen gas which was controlled by an electrically operated solenoid valve. A throttle valve was positioned just upstream of the solenoid valve and was used to adjust the flow of gas through the tube to control the random motion of the tube and thus optimize its cleaning ability. The solenoid valve and throttle valve were opened and adjusted to provide a stream velocity of 85 feet per second at the bottom of the collector assembly and the gas was allowed to clean the precipitator plates for a period of two minutes.

After the cleaning cycle, the precipitator was opened and inspected. The results showed a dramatic decrease in the amount of particle adherence on the surfaces of precipitator plates. Only a thin film of about 0.005 inch thick fine oxide was left on the precipitator plates. After multiple operation/cleaning cycles using this cleaning process the residual film deposited on the precipitator plates remained at the 0.005 inch thickness. In addition, during this operation 2719 grams of iron pentacarbonyl which was fed into the reactor yielded 783 grams of iron oxide particles of below 100 Å in size was collected which equates to a theoretical yield of 70.6%.

A comparable experiment wherein iron oxide was produced under the same conditions except that the cleaning cycles were performed using the prior art rapper method resulted in a particle layer build up on the precipitator plates of greater than 0.5 inch and only a 29% theoretical recovery of iron oxide.

This method of cleaning the precipitator plates offers a number of advantages over the prior art methods in addition to enhanced productivity. First, the cleaning operation is performed in situ and the process requires considerably less time than the prior art method so more frequent cleaning is possible resulting in improved production. The novel method is also quieter, safer and generally less obnoxious to operating personnel. The use of this method will result in greater yields during production runs, less expensive operation due to lower cleaning costs and less down time required for cleaning and, therefore, more efficient use of the precipitator.

We claim:

1. A method for cleaning an electrostatic precipitator comprising:

causing a flow of cleaning gas through at least one flexible tube positioned inside the precipitator housing, wherein said flow of gas is sufficient to cause the flexible tube to move about randomly thereby directing said flow of gas onto the electrostatic precipitator plates and further, said flow of gas being sufficient to cause particles which have adhered to said precipitator plates to be dislodged.

* * * * *